US011075037B2

(12) United States Patent
Pan et al.

(10) Patent No.: US 11,075,037 B2
(45) Date of Patent: Jul. 27, 2021

(54) OPENING/CLOSING INDICATING APPARATUS FOR CIRCUIT BREAKER OPERATING APPARATUS

(71) Applicant: Shanghai Liangxin Electrical Co., Ltd, Shanghai (CN)

(72) Inventors: Wanjun Pan, Shanghai (CN); Yanqun Yang, Shanghai (CN)

(73) Assignee: Shanghai Liangxin Electrical Co., LTD, Shanghai (CN)

( * ) Notice: Subject to any disclaimer, the term of this patent is extended or adjusted under 35 U.S.C. 154(b) by 0 days.

(21) Appl. No.: 16/760,134

(22) PCT Filed: Oct. 17, 2018

(86) PCT No.: PCT/CN2018/110714
§ 371 (c)(1),
(2) Date: Apr. 29, 2020

(87) PCT Pub. No.: WO2019/179087
PCT Pub. Date: Sep. 26, 2019

(65) Prior Publication Data

US 2020/0328040 A1 Oct. 15, 2020

(30) Foreign Application Priority Data

Mar. 21, 2018 (CN) ..... 201810236281.9

(51) Int. Cl.
*H01H 13/02* (2006.01)
*H01H 13/14* (2006.01)
*H01H 13/50* (2006.01)

(52) U.S. Cl.
CPC ..... *H01H 13/023* (2013.01); *H01H 13/14* (2013.01); *H01H 13/50* (2013.01)

(58) Field of Classification Search
CPC ..... H01H 13/83; H01H 2219/062; H01H 13/023; H01H 2219/036; H01H 13/14;
(Continued)

(56) References Cited

U.S. PATENT DOCUMENTS 6,225,881 B1 * 5/2001 Felden ..... H01H 71/04 335/167
6,803,535 B1 10/2004 Whipple et al.
(Continued)

FOREIGN PATENT DOCUMENTS

| | | |
|---|---|---|
| CN | 106710972 | 5/2017 |
| CN | 206806264 | 12/2017 |
| CN | 108461357 | 8/2018 |

OTHER PUBLICATIONS

International Search Report and Written Opinion issued in International Application No. PCT/CN2018/110714 dated Dec. 27, 2018, 2019.

(Continued)

*Primary Examiner* — Ahmed M Saeed
(74) *Attorney, Agent, or Firm* — Hogan Lovells US LLP

(57) ABSTRACT

An open/closed indicating apparatus for a circuit breaker operating apparatus, comprising a button and an indicating element. The button is provided therein with a cavity. The indicating element is mounted within the cavity. The indicating element can rotate within the cavity. The button is provided thereon with an observation window. The indicating element can display different areas in the observation window while rotating. When a small number of gaps are provided between the indicating element and the housing, the impact on the angle of rotation of the indicating element is reduced, the indicating element can accurately indicate an open/closed state of a circuit breaker, and when a product is being fitted and assembled, a requirement on gap fitness is reduced for the assembly.

20 Claims, 3 Drawing Sheets

(58) Field of Classification Search
CPC .. H01H 13/7065; H01H 13/705; H01H 13/04; H01H 13/20; H01H 3/12; H01H 13/50; H01H 13/704; H01H 71/04; H01H 2071/042; H01H 2069/016; H01H 9/16
See application file for complete search history.

(56) References Cited

U.S. PATENT DOCUMENTS 7,135,945 B2 * 11/2006 Whipple ..... H01H 71/04
335/17
7,358,838 B2 * 4/2008 Gibson ..... H01H 71/04
335/17
9,343,256 B1 * 5/2016 Gibson ..... H01H 71/522

OTHER PUBLICATIONS

English Translation of Chinese Abstracts.

* cited by examiner

OPENING/CLOSING INDICATING APPARATUS FOR CIRCUIT BREAKER OPERATING APPARATUS

TECHNICAL FIELD

The present disclosure pertains to the technical field of circuit breakers, and in particular relates to an opening/closing indicating apparatus for a circuit breaker operating apparatus.

BACKGROUND ART

For the conventional circuit breaker opening/closing operating apparatus currently available in the market, the button is disposed inside a mask, can move back and forth inside a sliding groove of the mask, and can be reset through a spring. A guide motion lever is arranged on an operating mechanism of the circuit breaker, the guide motion lever is fixed on the operating mechanism and can move back and forth within a certain range, and the guide motion lever has one end attached to the button on the mask, and the other end linked with an opening/closing shaft of the operating mechanism through structural parts. When an opening/closing operation is needed, the button is pressed, to enable the operating mechanism to complete a corresponding opening/closing action through the combined effect of the guide motion lever and related structural parts. For such conventional circuit breaker opening/closing operating apparatus, the circuit breaker is closed (switched-on) when the operation button is pressed down, the operation button of the circuit breaker rebounds to reset when an operating force is removed, and the circuit breaker is opened (switched off) when the button is pressed down again; when the circuit breaker is installed inside a cabinet and closed, the circuit breaker will not be open when the circuit breaker is pulled out, then an electric arc is generated at a wiring port of the circuit breaker, and endangers safety of nearby equipment. Therefore, the opening/closing state of the circuit breaker must be displayed, so as to ensure no occurrence of safety accidents due to false closing.

Chinese patent ZL201720171498.7 discloses a circuit breaker operating mechanism with an opening/closing indicating function, which includes a button and an indicating element, the button is provided therein with a cavity, the indicating element is mounted within the cavity, the indicating element can swing inside the cavity, the button is provided thereon with an observation window, and the indicating element can display different regions in the observation window while swinging. The operation button has two different states when the contact of the circuit breaker is closed and opened, and the indicating element can indicate both the closing state and opening state. However, in the moving process of the button of the indicating apparatus, a boss on housing pushes teeth on the indicating element to enable the indicating element to rotate inside the button. The boss on the housing is equivalent to one tooth of a straight gear, and moves utilizing the gear driving principle. In this case, the gear structure poses relatively high requirements on the gap, and when there is a relatively large fit gap between the housing and the indicating element, an relatively big error of an angle of rotation of the indicating element exists, such that the color of the part exposed from the button is inaccurate, half red and half green sometimes can be seen in an observation hole, then the closing/opening state of the circuit breaker cannot be accurately indicated. On the other hand, when the product is assembled with the cover being closed, two teeth on the indicating element cannot be accurately aligned or matched with the boss on the housing in a free state, which results that the boss on the housing is not between the two teeth on the indicating element after assembly, thus causing an assembly error, and reducing the production efficiency.

SUMMARY

An object of the present disclosure is to provide an opening/closing indicating apparatus for a circuit breaker operating apparatus, directed to the technical defects that the existing opening/closing indicating apparatus for a circuit breaker operating apparatus fails to provide accurate indication due to matched transmission of gears, and is hard to assemble. During movement of a button, a boss on a housing presses against a corresponding part of an indicating element inside the button, such that an indicating element has an indicating function; when the circuit breaker is in an open or closed position, corresponding part of the indicating element pressed by the boss on the housing is relatively far from a rotating center of the indicating element, a small gap between the indicating element and the housing has less impact on the angle of rotation of the indicating element, and the indicating element can accurately indicate the closing/opening state of the circuit breaker. Meanwhile, when a product is assembled with a cover being closed, when the indicating element is in a free state, regardless of the angle, the boss on the housing can press the indicating element to a correct position, thus increasing the production efficiency.

Technical Solution

In order to achieve the above technical object, an opening/closing indicating apparatus for a circuit breaker operating apparatus designed in the present disclosure includes a button and an indicating element, wherein the button is provided therein with a cavity, the indicating element is mounted inside the cavity, the indicating element can rotate inside the cavity, the button is provided thereon with an observation window, and during rotation, the indicating element can display different regions in the observation window, wherein the indicating element includes a rotating disc, a mounting rotating shaft extends from a side surface of the rotating disc, the mounting rotating shaft is rotatably mounted in a mounting hole in an inner wall of the cavity, a linkage wing platform is provided on an outer edge side of the rotating disc, a display handle extends from an outer edge surface of the rotating disc, a display surface of the display handle corresponds to the observation window, and the display surface can display different regions in the observation window during rotation of the indicating element; and the button is installed inside a button groove of the housing of the circuit breaker, and a boss is provided on the inner wall of the housing at a place corresponding to the linkage wing platform, and the button is connected with a handle through a U-shaped connecting rod.

Further, the linkage wing platform includes a left wing platform and a right wing platform, and the boss can respectively toggle (move) and press against the left wing platform or the right wing platform during rotation of the indicating element.

Further, the left wing platform and the right wing platform each include an arc-shaped toggling portion and a pressing straight portion.

Further, the observation window is provided on a left end surface of the button.

Further, the U-shaped connecting rod has one end mounted inside a waist-shaped long hole in the button, and the other end connected with the handle.

Preferably, the display handle is an elastic display handle.

Preferably, the linkage wing platform is elastic.

Beneficial Effect

For the opening/closing indicating apparatus for a circuit breaker operating apparatus provided in the present disclosure, during the movement of the button, the boss on the housing presses against the corresponding part of the indicating element inside the button, such that the indicating element has an indicating function; when the circuit breaker is in an open or closed position, corresponding part of the indicating element pressed by the boss on the housing is relatively far from a rotating center of the indicating element, the angle of rotation of the indicating element is less affected when there is a small gap between the indicating element and the housing, and the indicating element can accurately indicate the closing/opening state of the circuit breaker. Meanwhile, when the product is assembled with the cover being closed, clearance fit requirement of assembly is relatively low. When the indicating element is in a free state, regardless of the angle, the boss on the housing can press the indicating element to a correct position, thus increasing the production efficiency.

DETAILED DESCRIPTION OF EMBODIMENTS

The present disclosure is further described in detail below in combination with accompanying drawings and embodiments.

Embodiment

Figure 1:
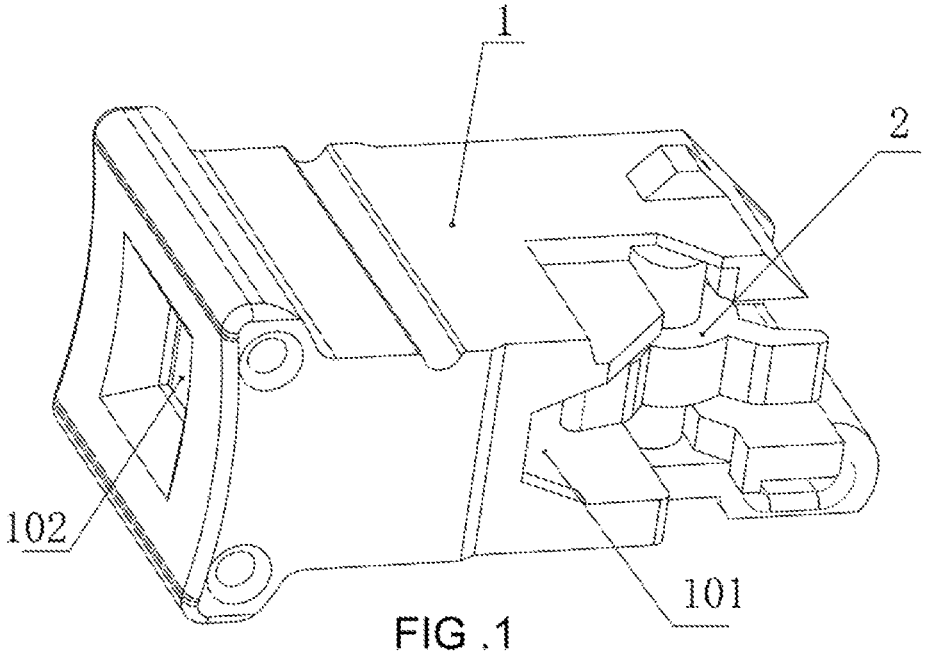
FIG. 1 is a structural schematic view of an embodiment of the present disclosure.

As shown in FIG. 1, an opening/closing indicating apparatus for a circuit breaker operating apparatus includes a button 1 and an indicating element 2, wherein the button 1 is provided therein with a cavity 101, the indicating element 2 is mounted inside the cavity 101, the indicating element 2 can rotate inside the cavity 101, the button 1 is provided thereon with an observation window 102, and the observation window 102 is provided on a left end surface of the button 1. During rotation, the indicating element 2 is able to display different regions in the observation window 102.

Figure 2:
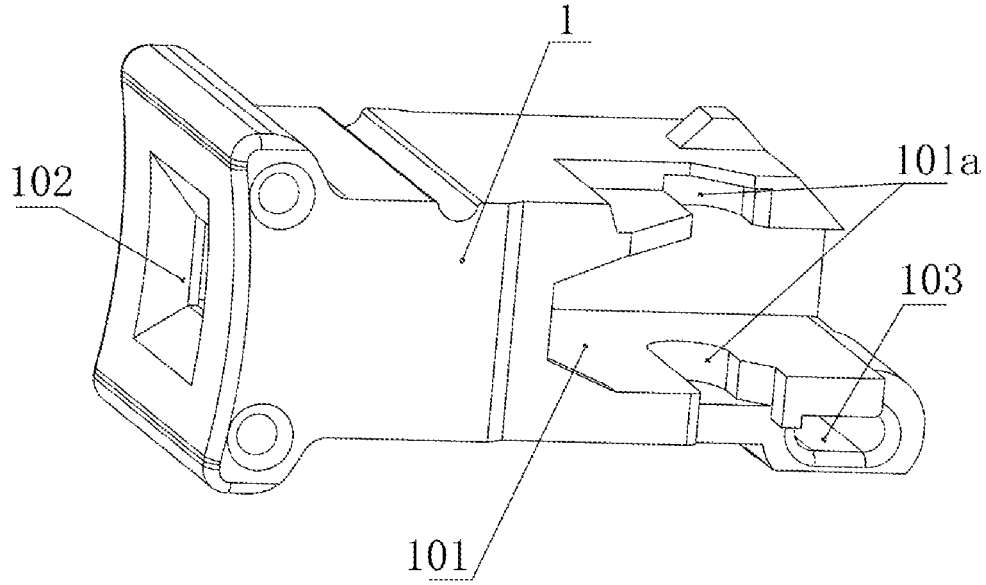
FIG. 2 is a structural schematic view of a button in an embodiment of the present disclosure.
Figure 3:
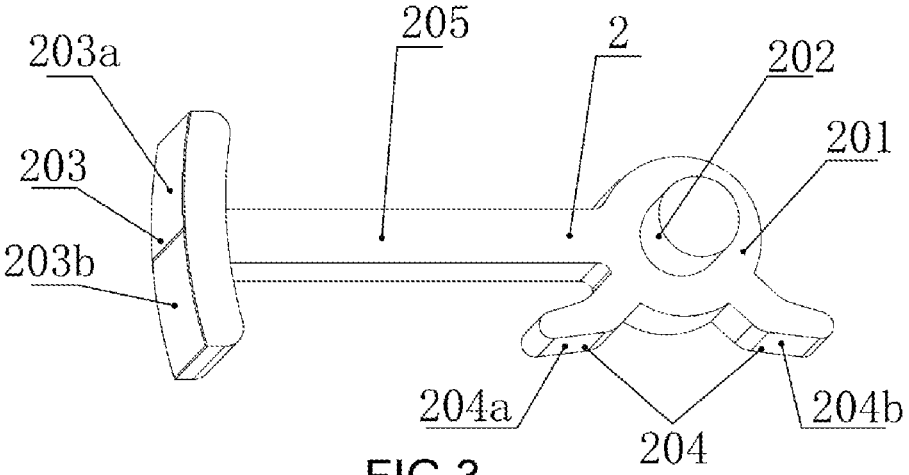
FIG. 3 is a structural schematic view of an indicating element in an embodiment of the present disclosure.
Figure 6:
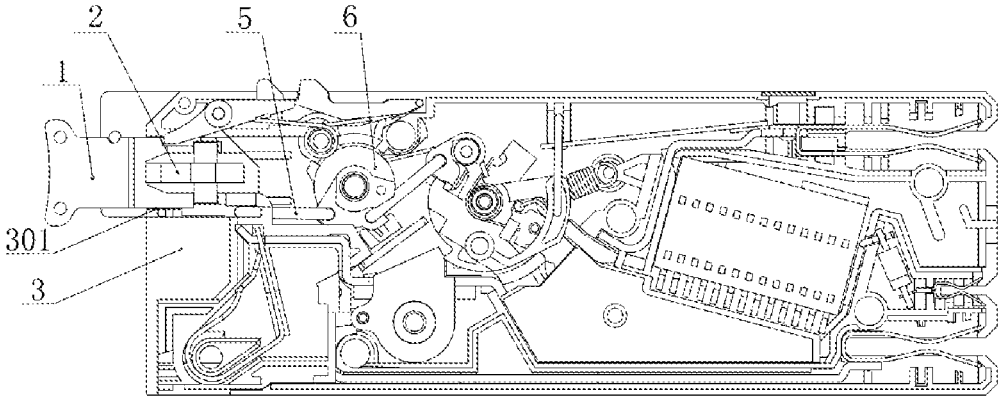
FIG. 6 is a schematic view showing a position of the indicating element in the circuit breaker in an embodiment of the present disclosure.

As shown in FIG. 3, the indicating element 2 includes a rotating disc 201, a mounting rotating shaft 202 extends from a side surface of the rotating disc 201, the mounting rotating shaft 202 is mounted in a mounting hole 101*a* in an inner wall of the cavity 101 and can rotate, a linkage wing platform 204 is provided on an outer edge side of the rotating disc 201, a display handle 205 extends from an outer edge surface of the rotating disc 201, a display surface 203 of the display handle 205 corresponds to the observation window 102, the display surface 203 includes a region 203*a* and a region 203*b*, and the display surface 203 can display different regions in the observation window 102 during the rotation of the indicating element 2, wherein the region 203*a* is green, and the region 203*b* is red;

As shown in FIG. 6, the button 1 is installed inside a button groove 301 of a housing 3 of the circuit breaker, and as shown in FIG. 2, a boss 4 is provided on the inner wall of the housing 3 at a place corresponding to the linkage wing platform 204, and the button 1 is connected with a handle 6 through a U-shaped connecting rod 5. The U-shaped connecting rod 5 has one end mounted inside a waist-shaped long hole 103 in the button 1, and the other end connected with the handle 6.

In detail, the linkage wing platform 204 includes a left wing platform 204*a* and a right wing platform 204*b*, and the boss 4 can respectively toggle and press against the left wing platform 204*a* or the right wing platform 204*b* during the rotation of the indicating element 2. The left wing platform 204*a* and the right wing platform 204*b* each include an arc-shaped toggling portion and a pressing straight portion.

Figure 4:
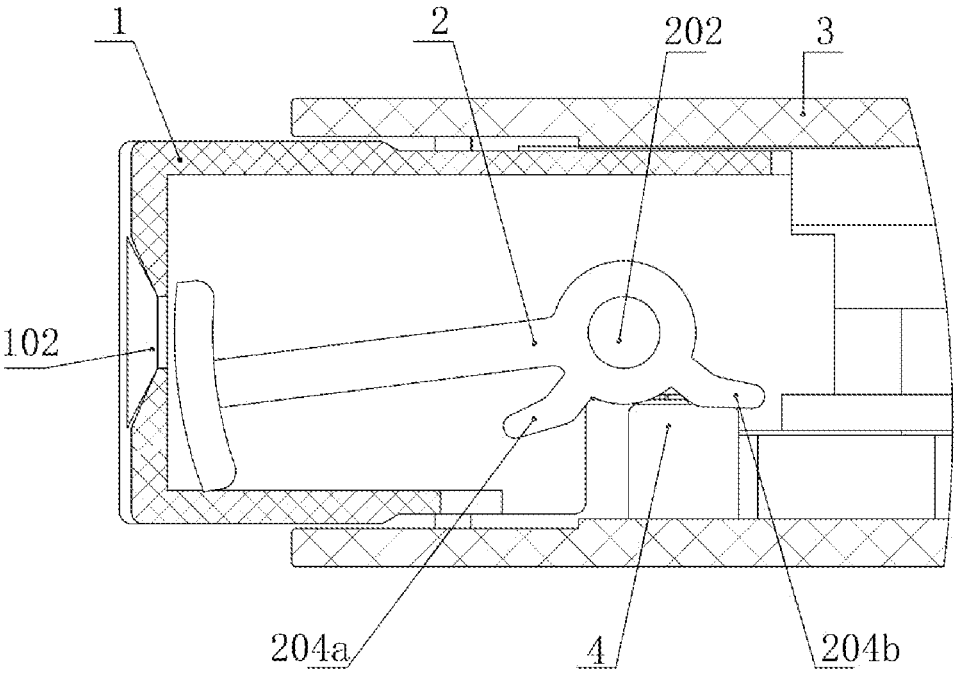
FIG. 4 is a schematic view showing a position of the indicating element in an embodiment of the present disclosure, with a circuit breaker being in an open position.

As shown in FIG. 4, showing an open state of the circuit breaker, the boss 4 on the housing 3 presses against the right wing platform 204*b* of the indicating element 2, a lower side of the display surface 203 of the indicating element 2 on the left abuts against a lower wall of the cavity 101 inside the button 1, the display surface 203*a* directly faces the observation window 102, and the color of the indicating element 2 is green viewed from the observation window 102. The button 1 is pushed to the right to drive the circuit breaker mechanism to rotate such that the circuit breaker is closed. After the button 1 is released, the button 1 stays in the closed position, the boss 4 on the housing 3 changes from pressing against the right wing platform 204*b* of the indicating element 2 to pressing against the left wing platform 204*a* of the indicating element 2 in the process of pressing down the button 1, the indicating element 2 rotates clockwise, the indicating element 2 changes from the display region 203*a* to the display region 203*b* as seen from the observation window 102, and the color changes from green to red.

Figure 5:
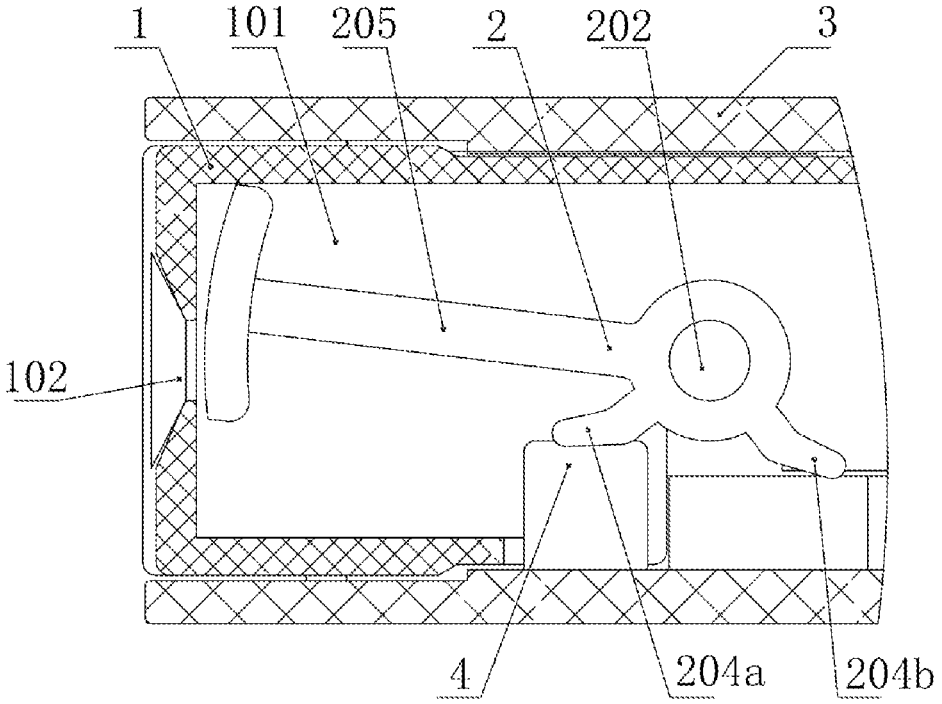
FIG. 5 is a schematic view showing a position of the indicating element in an embodiment of the present disclosure, with the circuit breaker being in a closed position.

As shown in FIG. 5, showing a closed state of the circuit breaker, the boss 4 on the housing 3 presses against the left wing platform 204*a* of the indicating element 2, an upper side of the display surface 203 of the indicating element 2 on the left abuts against an upper wall of the cavity 101 inside the button 1, the display surface 203*b* directly faces the observation window 102, and the color of the indicating element 2 is red viewed from the observation window 102. The button 1 is pulled to the left to drive the circuit breaker mechanism to rotate such that the circuit breaker is opened. After the button 1 is released, the button 1 stays in the open position, the boss 4 on the housing 3 changes from pressing against the left wing platform 204*a* of the indicating element 2 to pressing against the right wing platform 204*b* of the indicating element 2 in the process of pulling out the button 1, the indicating element 2 rotates anticlockwise, the indicating element 2 changes from the display region 203*b* to the display region 203*a* as seen from the observation window 102, and the color changes from red to green.

Embodiment 2

The present disclosure further provides an embodiment in which the display handle 205 connected between an observation surface and the rotating disc 201 of the indicating element 2 is an elastic part, and after the observation surface of the indicating element 2 on the left contacts the side wall of the button 1, the boss 4 on the housing 3 presses against the left wing platform 204*a* and the right wing platform 204*b* of the indicating element 2, so that the display handle 205 between the observation surface and the rotating shaft of the indicating element 2 is elastically deformed. Modes of other workpieces of the indicating apparatus in the present embodiment are the same as those in Embodiment 1.

Embodiment 3

The present disclosure further provides an embodiment in which the left wing platform 204*a* and the right wing platform 204*b* of the linkage wing platform 204 of the indicating element 2 are elastic parts, and after the observation surface of the indicating element 2 on the left contacts the side wall of the button 1, the boss 4 on the housing 3 presses against the left wing platform 204*a* and the right wing platform 204*b* of the indicating element 2, so that the left wing platform 204*a* and the right wing platform 204*b* of the indicating element 2 are elastically deformed. Modes of other workpieces of the indicating apparatus in the present embodiment are the same as those in Embodiment 1.

The structures, ratios, sizes, quantities and so on depicted in the accompanying drawings of the embodiments of the present disclosure are only used to match the contents disclosed in the description, to be understood and read by those familiar with the art, rather than being used to limit conditions under which the present disclosure can be implemented, therefore, they do not have technical significance, and any structural modifications, changes of ratio relationship, or adjustments of sizes, without affecting the efficacy and the purpose that can be produced and achieved by the present disclosure, should still fall within the scope that can be covered by the technical contents disclosed in the present disclosure. Meanwhile, wordings such as "upper", "lower", "left", "right", "middle", "clockwise", and "anticlockwise" referred to in the present description are also used for clarity of description only, rather than being used to limit the implementable scope of the present disclosure, and changes or adjustment of the relative relationship therebetween, without substantial technical changes, also should be considered as the implementable scope of the present disclosure.

What is claimed is:

1. An apparatus for indicating opening/closing of a circuit breaker operating apparatus, comprising a button and an indicating element, wherein the button is provided therein with a cavity, the indicating element is located inside the cavity, the indicating element is rotatable inside the cavity, the button is provided thereon with an observation window, and the indicating element is capable of displaying different regions in the observation window during rotation, wherein the indicating element comprises a rotating disc, a mounting rotating shaft extends from a side surface of the rotating disc, the mounting rotating shaft is rotatably mounted in a mounting hole in an inner wall of the cavity, a linkage wing platform is provided on an outer edge side of the rotating disc, a display handle extends from an outer edge surface of the rotating disc, a display surface of the display handle corresponds to the observation window, and the display surface is capable of displaying different regions in the observation window during rotation of the indicating element; and the button is installed inside a button groove of a housing of the circuit breaker, and a boss is provided at a position of an inner wall of the housing with a position corresponding to the linkage wing platform, and the button is connected with a handle through a U-shaped connecting rod.

2. The apparatus according to claim 1, wherein the linkage wing platform comprises a left wing platform and a right wing platform, and the boss is capable of respectively toggling and pressing against the left wing platform or the right wing platform during rotation of the indicating element.

3. The apparatus according to claim 2, wherein the left wing platform and the right wing platform each comprise an arc-shaped toggling portion and a pressing straight portion.

4. The apparatus according to claim 1, wherein the observation window is provided on a left end surface of the button.

5. The apparatus according to claim 1, wherein the U-shaped connecting rod has one end mounted inside a waist-shaped long hole in the button, and the other end connected with the handle.

6. The apparatus according to claim 1, wherein the display handle is an elastic display handle.

7. The apparatus according to claim 1, wherein the linkage wing platform is an elastic linkage wing platform.

8. The apparatus according to claim 2, wherein the observation window is provided on a left end surface of the button.

9. The apparatus according to claim 3, wherein the observation window is provided on a left end surface of the button.

10. The apparatus according to claim 2, wherein the U-shaped connecting rod has one end mounted inside a waist-shaped long hole in the button, and the other end connected with the handle.

11. The apparatus according to claim 3, wherein the U-shaped connecting rod has one end mounted inside a waist-shaped long hole in the button, and the other end connected with the handle.

12. The apparatus according to claim 4, wherein the U-shaped connecting rod has one end mounted inside a waist-shaped long hole in the button, and the other end connected with the handle.

13. The apparatus according to claim 2, wherein the display handle is an elastic display handle.

14. The apparatus according to claim 3, wherein the display handle is an elastic display handle.

15. The apparatus according to claim 4, wherein the display handle is an elastic display handle.

16. The apparatus according to claim 5, wherein the display handle is an elastic display handle.

17. The apparatus according to claim 2, wherein the linkage wing platform is an elastic linkage wing platform.

18. The apparatus according to claim 3, wherein the linkage wing platform is an elastic linkage wing platform.

19. The apparatus according to claim 4, wherein the linkage wing platform is an elastic linkage wing platform.

20. The apparatus according to claim 5, wherein the linkage wing platform is an elastic linkage wing platform.

* * * * *